US006125675A

United States Patent [19]

Benedict et al.

[11] Patent Number: 6,125,675

[45] Date of Patent: Oct. 3, 2000

[54] WIRE DRAW MACHINE WITH INTEGRAL COIL-SUPPORTING TABLE

[75] Inventors: Roger J. Benedict; Troy McCabe, both of Rockford, Ill.

[73] Assignee: Fastener Engineers Group, Inc., Rockford, Ill.

[21] Appl. No.: 09/295,042

[22] Filed: Apr. 20, 1999

Related U.S. Application Data

[63] Continuation-in-part of application No. 08/803,190, Feb. 19, 1997, abandoned.

[51] Int. Cl.[7] ..... B21C 1/14; B21D 55/00

[52] U.S. Cl. ..... 72/5; 72/289

[58] Field of Search ..... 72/289, 290, 280, 72/274, 5

[56] References Cited

U.S. PATENT DOCUMENTS

| | | | |
|---|---|---|---|
| 221,254 | 11/1879 | Rogers . | |
| 407,612 | 7/1889 | Rawson . | |
| 413,889 | 10/1889 | Beguz | 72/280 |
| 440,133 | 11/1890 | Burnes . | |
| 549,051 | 10/1895 | Bergmann | 72/5 |
| 1,171,984 | 2/1916 | Shannon | 72/5 |
| 1,470,375 | 10/1923 | Boley | 72/280 |
| 1,501,305 | 7/1924 | Boley | 72/280 |
| 1,865,781 | 7/1932 | Najarian . | |
| 1,964,529 | 6/1934 | Newton | 72/280 |
| 2,349,104 | 5/1944 | Morgan | 72/5 |
| 3,339,396 | 9/1967 | Carlson . | |
| 3,709,021 | 1/1973 | Jackman | 72/289 |
| 4,099,403 | 7/1978 | Alcock | 72/289 |
| 5,097,688 | 3/1992 | Taylor | 72/5 |

FOREIGN PATENT DOCUMENTS

| | | |
|---|---|---|
| 1035482 | 2/1962 | United Kingdom . |
| 2046648 | 4/1980 | United Kingdom . |

*Primary Examiner*—Daniel C. Crane
*Attorney, Agent, or Firm*—Keith Frantz

[57] ABSTRACT

A wire drawing machine includes a draw die for reducing unfinished wire to a predetermined size, a power-driven capstan rotatable about a horizontal axis for drawing wire through the die, and an integral floor-mounted coil-supporting table which carries a coil of unfinished wire for processing through the die. The machine components are located in and connected to a generally L-shaped housing proximate to and wrapping partially around the coil-supporting table. The wire is guided along a path above the coil and housing as the wire travels from the coil to the die such that the floor space needed to process the unfinished wire is confined to the combined space of the turntable and housing.

39 Claims, 11 Drawing Sheets

WIRE DRAW MACHINE WITH INTEGRAL COIL-SUPPORTING TABLE

This application is a continuation-in-part of application Ser. No. 08/803,190 filed Feb. 19, 1997, now abandoned.

BACKGROUND OF THE INVENTION

This invention relates generally to a wire drawing machine adapted to draw unfinished wire to a finished size and to supply the finished wire to a using station such as a cold header located downstream of the machine. More particularly, the invention relates to a wire drawing machine with an integral coil-supporting table adapted to carry a coil of unfinished wire for supplying wire to the finishing operation of the machine.

In conventional wire drawing machines, the wire is initially threaded through a drawing die, wrapped several times around a drum or capstan located downstream of the die, and then fed into the using station. The drawing die is set to finish the wire to a predetermined size. The capstan is adapted to be rotated by a variable speed drive mechanism including, for example, an electric motor and gear reducer. During normal operation of the machine, the rotating capstan pulls the unfinished wire through the die to reduce the diameter of the wire, whereupon the finished wire winds around and then off of the capstan and is made available to the using station. A wire drawing machine of this general type is disclosed in Alcock et al U.S. Pat. No. 4,099,403.

In a wire drawing operation of this type, the coil of unfinished wire typically rests on a turntable which is adapted for relatively free rotation about a vertical axis. The turntable typically includes a generally horizontal platform for supporting the coil of wire and centrally located guides which project upwardly from the platform through the center of the coil. The coil of unfinished wire is supplied resting on a base plate and wrapped around a center core section which is connected to and extends upwardly from the base plate. The coil is positioned onto the turntable by grabbing the top of the core section, lifting the coil above the turntable guides, aligning the center of the coil with the guides, and lowering the coil of wire onto the turntable. As the coil is lowered, the guides are received into the core section to center the coil on the turntable. With this arrangement, the turntable rotates and unfinished wire unwinds from the coil as the capstan draws the wire through the die.

In a conventional prior wire finishing operation, the turntable is floor-mounted which enables the coil of wire to be easily loaded onto the turntable. The turntable of such prior operations is also located a substantial distance behind the wire drawing machine to provide for a relatively straight length of wire feeding into the die. However, such an arrangement requires substantial floor space which could be utilized for other manufacturing purposes, and is thus an economic detriment to efficient use of available facilities.

Taylor et al U.S. Pat. No. 5,097,688 discloses a wire drawing machine with an overhead turntable to reduce the floor space necessary for the entire wire drawing operation. In the Taylor arrangement, the capstan and die are connected to the side of a generally cubic frame and the turntable is mounted to the upper surface or shelf of the frame above the capstan. Thus, the top of the guides of the Taylor arrangement are relatively high above the ground. As a result, either a special fork lift or an overhead crane is typically necessary to raise the coil of wire above the turntable guides for loading onto the turntable. This results in a substantial additional expense where such handling equipment is not already in place, and is not feasible in some existing facilities with limited ceiling heights.

SUMMARY OF THE INVENTION

The general aim of the present invention is to provide for a new and improved wire drawing machine with an integral coil-supporting table to reduce the floor space necessary for a wire finishing operation when compared to such conventional prior operations.

Another general aim of the invention is to provide a wire drawing machine having an integral coil-supporting table which is floor-mounted for ease of loading of a coil of wire thereon with, for example, a conventional fork lift.

The foregoing is achieved, in part, by providing a uniquely configured frame structure which is adapted to support the capstan and drive arrangement, the die and other components of the machine, and an integral coil-supporting table. To this end, the frame includes a base portion underlying and supporting the turntable and a relatively narrow housing portion which wraps partially around the table to minimize the floor space required for the machine.

The invention also resides in provision of novel means for guiding the wire along a path that remains substantially within the footprint of the table and the housing to eliminate the need for additional floor space that is required in conventional wire finishing operations for the wire path between the coil and the die.

A detailed objective of the invention is to provide a wire draw machine with an integral, rotatably supported turntable for supporting a coil of wire, and means to guide the wire along a substantially horizontal path around the turntable and generally above the frame.

Another detailed objective is to provide an alternate wire draw machine with an integral, stationary table for supporting a coil of wire, and means to guide the wire along a generally vertical path above the table and frame.

These and other objectives and advantages of the invention will become more apparent from the following detailed description when taken in conjunction with the accompanying drawings.

Figure 1:
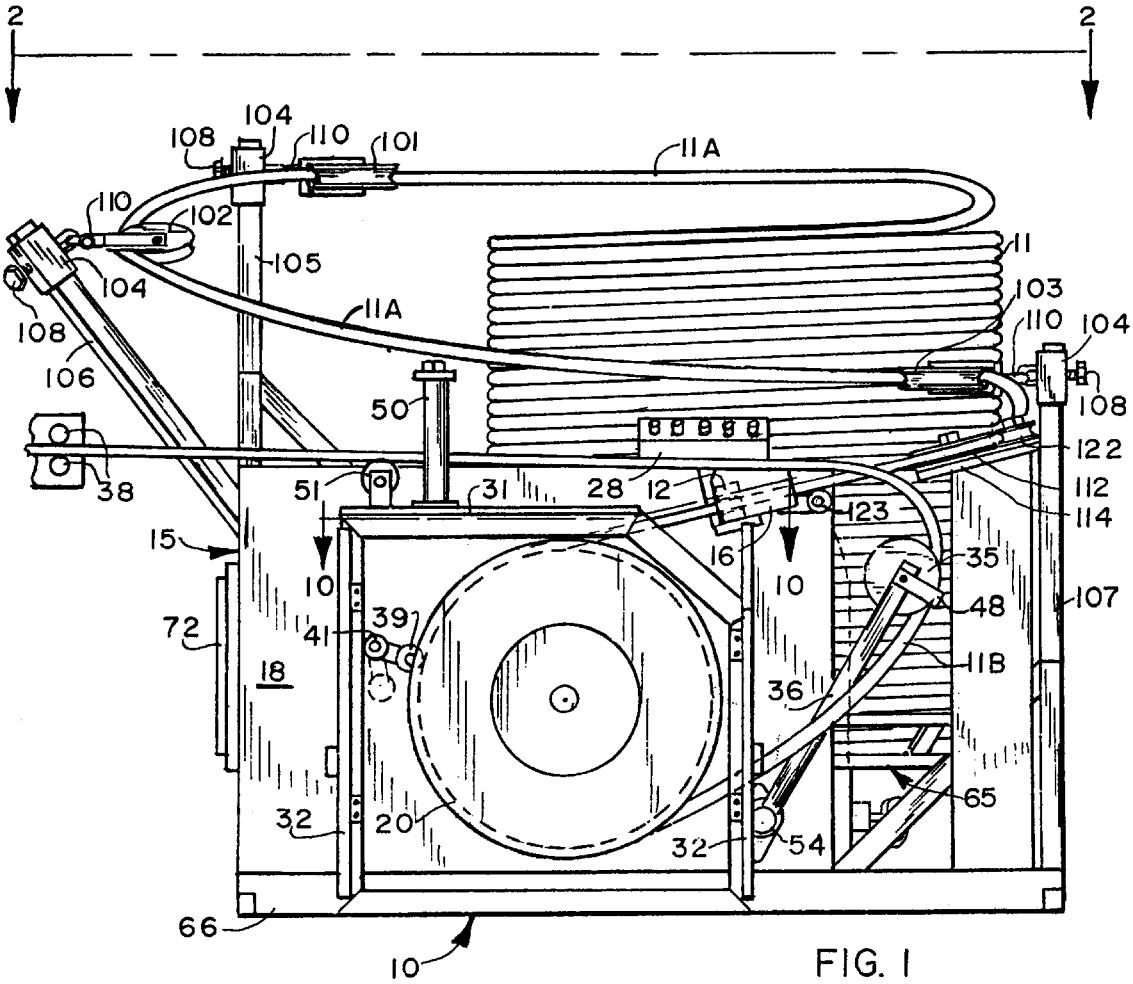
FIG. 1 is a side elevational view of a new and improved wire drawing machine incorporating the unique features of the present invention, and showing a coil of unfinished wire resting on a rotatable turntable and the wire as it travels through the machine.
Figure 5:
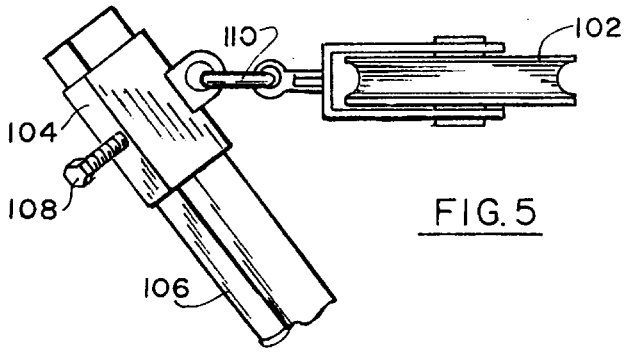
FIG. 5 is an enlarged fragmentary view of certain parts shown in FIG. 1.

While the invention is susceptible of various modifications and alternative constructions, certain illustrated embodiments have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENT

For purposes of illustration, one embodiment of the present invention is shown in the drawings in a wire drawing machine 10 (FIG. 1) adapted to draw unfinished wire 11*a* through a finishing die 12 to reduce the diameter of the wire to a predetermined size and to supply the finished wire 11*b* to a using machine (not shown) such as a cold header located downstream of the wire drawing machine.

Figure 2:
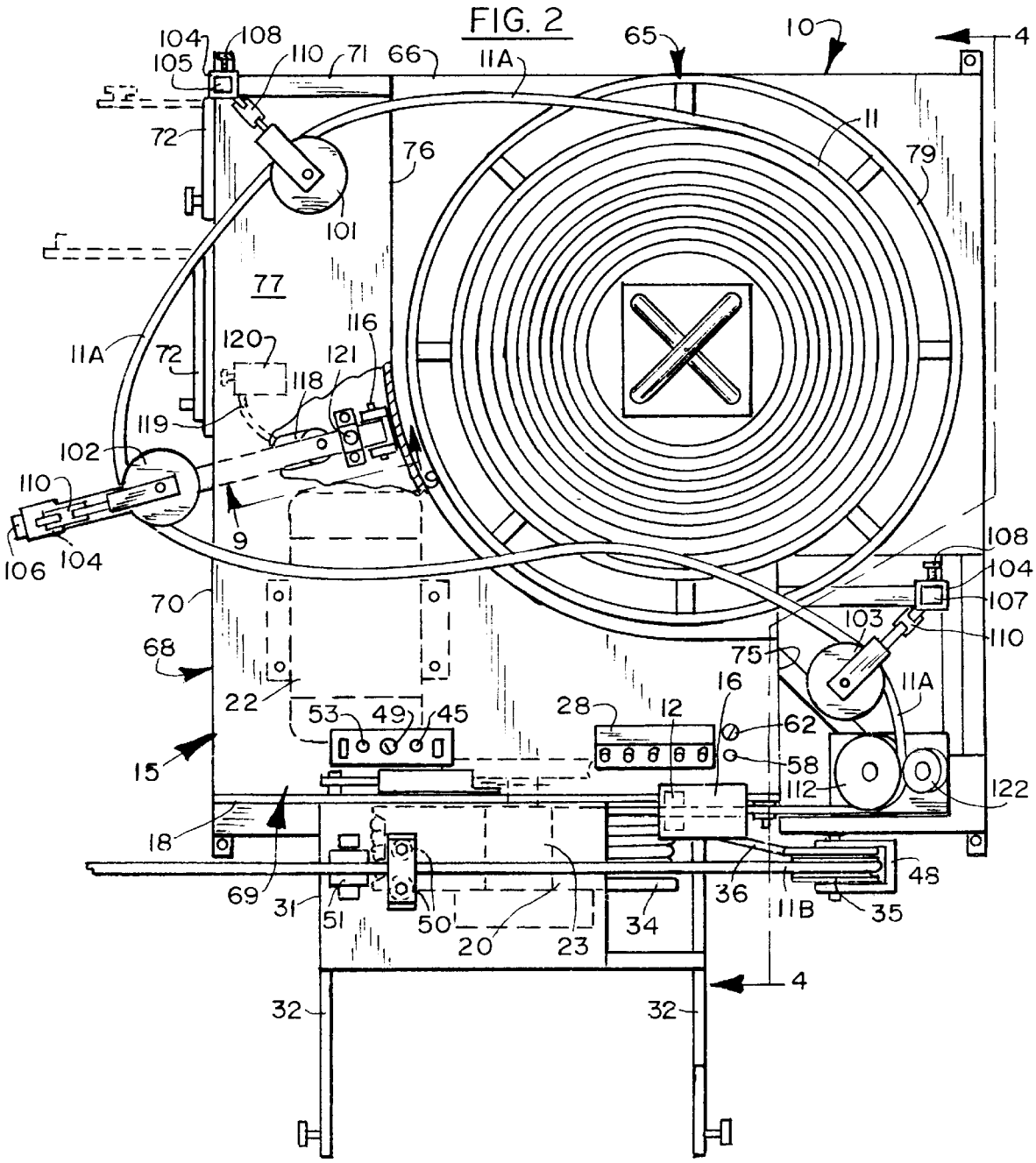
FIG. 2 is a top plan view of the machine as seen from the line 2—2 of FIG. 1.
Figure 8:
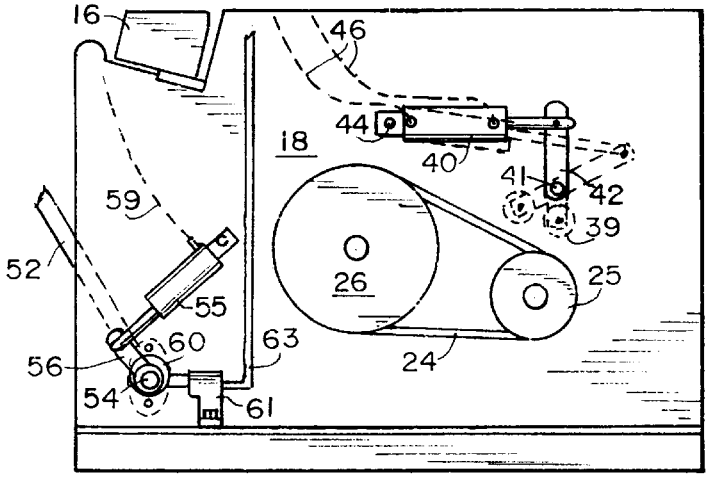
FIG. 8 is a view of certain parts as seen substantially from the line 8—8 of FIG. 4.

The wire drawing machine 10 includes a housing 15, a die box 16 secured to an outer side wall 18 of the housing, and a spool-shaped drum or capstan 20 located downstream of the die. The capstan extends outwardly from the side wall 18 and includes a centrally located shaft 21 which is journaled in the housing to enable rotation of the capstan about a horizontal and laterally extending axis through the center of the shaft. During normal operation of the machine, the capstan is rotated by way of a variable speed mechanism such as a mechanism comprising an electric motor 22 (FIG. 2) and a belt 24 (FIG. 8) operably connected between a pulley 25 of the motor and a pulley 26 of a gear reducer 23 which is operably connected to the shaft 21. Electrical controls 28 enable selective operation of the electric motor and, thus, the wire drawing machine.

Figure 10:
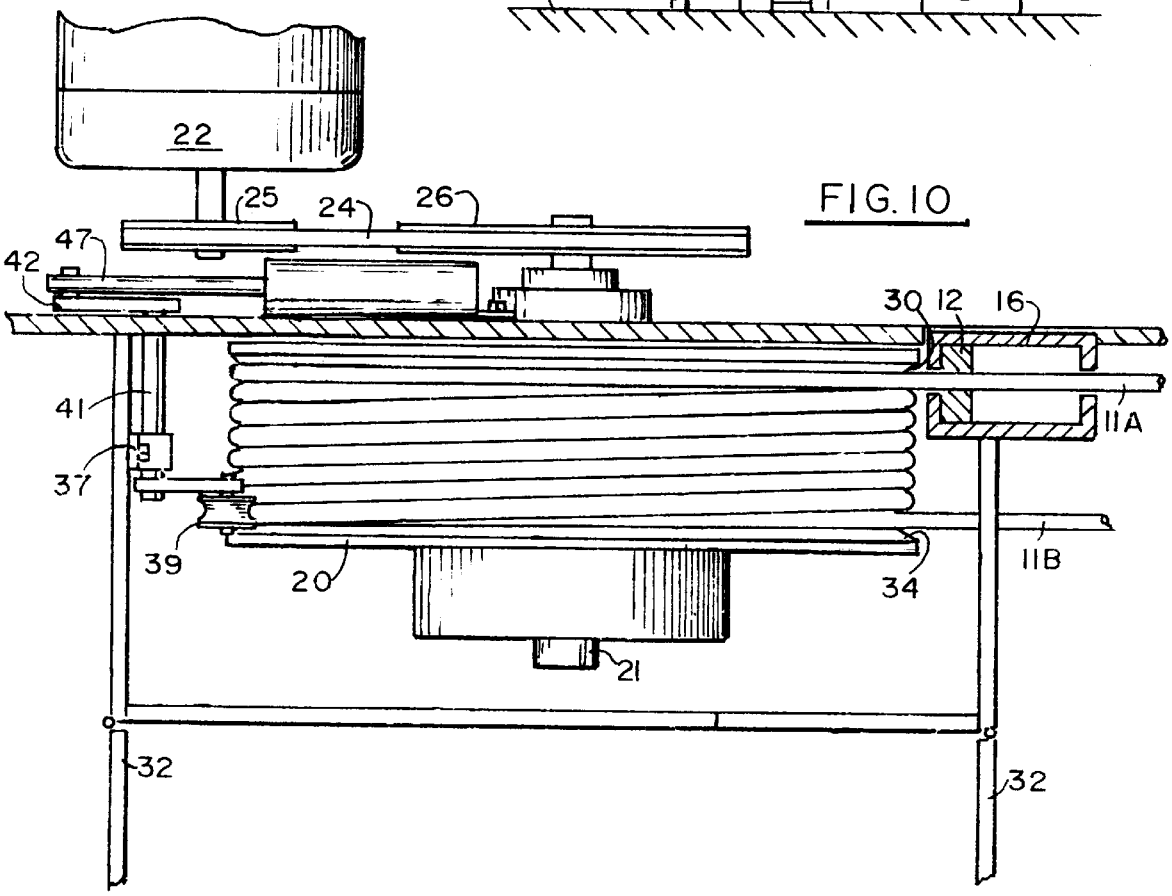
FIG. 10 is an enlarged fragmentary cross-sectional view of certain parts as seen substantially along the line 10—10 of FIG. 1.

As best shown in FIG. 10, the die box 16 is generally aligned with the inside or entrance edge portion 30 of the capstan 20. The draw die 12 is removably secured inside the die box for selective use of one of a number of predetermined die sizes. To provide for the safety of the operator and other persons in the vicinity, and to generally prevent objects from falling into the rotating capstan, the capstan is substantially enclosed in a housing 31. Hinged access panels 32 (shown open in FIGS. 1 and 2) are provided on the outer side of the housing 31 for maintenance purposes and for initially wrapping the wire onto the capstan.

Initially, wire from a coil 11 of unfinished wire is threaded by hand through the die 12 and is wrapped several times around the capstan 20 in a single layer, progressing from the inside edge portion 30 to the outer or exit edge portion 34 of the capstan. The wire is then looped around a pulley 35 (FIG. 1) of a speed compensating arm 36 and into pulling feed rollers 38 associated with the using station. A conventional hand operated roller (not shown) may optionally be provided for selectively clamping the first wrap of wire against the capstan as an operator initially wraps the wire onto the capstan.

During normal operation of the machine 10, the rotating capstan 20 pulls unfinished wire 11*a* through the die 12 to reduce its diameter to a predetermined or finished size. As the finished wire 11*b* exits the die, it wraps onto the capstan along the inside edge portion 30 and progresses toward the outer edge portion 34 as the capstan rotates. The wire then exits from the capstan whereupon it loops around the pulley 35 and is made available to the using station. As further described below, the compensating arm 36 operates to adjust the speed of the capstan so that the rate of wire exiting the capstan approximately matches the average rate of wire pulled into the using station.

A roller 39 located inside the capstan housing 31 is generally aligned with the exit end portion 34 of the capstan 20. The roller is operatively connected to a double acting pneumatic cylinder 40 (FIG. 8) for selective movement toward and away from the capstan for clamping the last wrap or wire against the capstan during machine operation. In this way, the roller 39 isolates the loop of wire 11*b* between the capstan and the using station from the wire which is tightly wrapped onto the capstan, thus preventing the wire on the capstan from slipping or unwinding as the capstan rotates.

In the embodiment shown, a shaft 41 (FIG. 10) is journaled in the sidewall 18 and a journal block 37 to overhang the exit end portion 34 of the capstan 20. The roller 39 is connected to the outer end of the shaft for swinging toward and away from the capstan as the shaft 41 rotates back and forth. The cylinder 40 is mounted to the backside of the sidewall 18 for pivoting at 44, and linkage member 42 is connected between the shaft 41 and the cylinder rod 47 to convert the linear stroke of the cylinder into limited angular rotation of the shaft. The cylinder is connected to an adjustable pressure regulator 45 by pneumatic lines 46. With this arrangement, the operator of the machine 10 can move the roller toward or away from (as shown in dashed lines) the capstan, and adjust the clamping pressure of the roller on the last wrap of wire on the capstan by adjusting the pressure in the cylinder. In this instance, a pressure gauge 49 is provided for monitoring the pressure to the cylinder 40, and an on-off switch 53 selectively disables the pressure supply to the cylinder.

As the finished wire 11*b* exits the capstan 20 (FIG. 1), the wire is guided between the pulley 35 and a generally U-shaped guide 48 which extends around the upstream periphery of the pulley. There is typically some tension in the exit length of wire 11*b* resulting, in part, from the feed rollers 38 pulling wire into the using station. The guide 48 prevents the wire from falling away from the pulley when this tension is not present, such as when the machine is shut-off.

After passing the pulley 35, the finished wire 11*b* loops around and over the housing 31 of the capstan 20 in a generally horizontal and forwardly traveling path to the using station. Two upright rollers 50 located near the forward end of the housing maintain alignment of the wire as it travels from the pulley toward the using station. A horizontal roller 51 prevents the wire from contacting the housing 31 of the capstan, particularly in the event that the feed rollers 38 of the using station are located below the upper surface of the housing.

The compensating arm 36 (FIG. 1) includes the pulley 35 mounted for rotation about a horizontal and laterally extending axis near the upper end thereof, and is generally aligned with the outer edge portion 34 of the capstan 20 to engage the wire 11*b* as it exits the capstan. To this end, a horizontal and laterally extending pin 54 connected to the lower end of the arm is journaled in the sidewall 18 to provide for pivotal movement or swinging of the pulley 35 in a plane extending perpendicular to the axis of rotation of the capstan. Thus, the pulley swings in a plane extending through the wire as it exits the capstan.

A pneumatic cylinder 55 pivotally mounted to the inside of the side wall 18 is operatively connected to the compensating arm 36 for biasing the arm in a clockwise direction as viewed in FIG. 1. The cylinder rod is connected to a linkage member 56 which, in turn, is connected to the inside end of the pin 54 such that the link swings, and the pin and compensating arm rotate, as the pneumatic cylinder moves.

The pressure in the cylinder 55 is controlled by an adjustable pressure regulator 58, the two being connected by a pneumatic line 59. During normal operation of the machine 10, air pressure is provided to the cylinder to swing the compensating arm in a clockwise direction. Thus, the compensating arm normally takes up the slack in the loop of wire 11*b* between the capstan and the using station. Advantageously, the cylinder also provides damping in the arm 36 to minimize the effects of the typical intermittent pulling action of the feed rollers 38 of the using station.

In order to insure a continuous supply of wire 11*b* to the using station, the compensating arm 36 and operatively associated components are adapted to control the speed of the capstan 20 in response to the rate of wire which is pulled into the using station by the feed rollers 38.

To this end, a cam 60 (FIG. 8) is securely connected to the inside end portion of the pin 54, and a proximity sensor 61 is positioned in operable relation to the cam. The proximity sensor is adapted to sense the air gap between the operative end of the sensor and the cam, and to provide an electrical output signal via wiring 63 based upon this air gap in a conventional manner. The cam is profiled such that a predetermined relationship is established between the angular position of the compensating arm 36, the air gap, and the output from the sensor. The sensor is electrically connected to a controller (not shown) which processes the signal as an input signal or error signal in a conventional speed control system for controlling the speed of the electric motor 22 and thus the speed of the capstan 20.

With this arrangement, the speed of the capstan 20 is adjusted as the size of the exit loop of wire 11*b* changes so that the pull rate of wire through the die 12 approximately matches the using rate of the finished wire. If the using rate of wire decreases, the size of the exit loop 11*b* increases and the compensating arm 36 will swing in a clockwise direction, rotating the cam 60 and causing the signal from the proximity sensor 61 to change according to the predetermined relationship. The speed controller responds to the new signal by slowing down the rotational speed of the electric motor 22 and the capstan 20. If the exit loop 11*b* becomes sufficiently large, such as if the using station has been turned off, the resulting swing of the compensating arm will cause the capstan to completely stop. Alternately, if the using rate of wire increases, the added tension on the exit loop of wire will pull the arm in the counter-clockwise direction and the controller will increase the speed of the capstan to compensate for the increased using rate of the wire.

In accordance with one aspect of the invention, the wire drawing machine 10 includes an integral floor-mounted, rotatable, coil-supporting table or turntable 65, the housing 15 being uniquely adapted to wrap around a portion of the turntable for carrying the components of the machine. With this arrangement, the floor space required for the machine is minimized while maintaining ease of access to the turntable for loading coils 11 of wire.

More specifically, the machine 10 includes a frame structure with the upright housing portion 15 and with a horizontally extending base 66 which rests on the floor and which underlies and supports the turntable 65. In the embodiment shown, the base 66 is formed from a metal plate which extends under both the housing 15 and the turntable. Alternately, the base may be constructed from, for example, structural members which are welded or otherwise secured together, for supporting the housing and the turntable.

In the carrying out one embodiment, the housing 15 includes a front section 68 (FIG. 2) and a side section 69 connected to extending rearwardly from the front section, these sections being positioned relatively close to the turntable 65 and partially encircling the turntable. The front section includes a front panel 70, an end panel 71 at the end opposite the side section 69, and pivotally mounted doors 72 for access to the motor 22, electrical wiring, and various electrical control and other components located in the front section of the housing. The side section includes the side wall panel 18 and a rear end panel 75.

In the preferred embodiment, the inner sides of the housing sections 68 and 69 are closed by a continuous panel 76 which is spaced inwardly from both the front and side panels, 70 and 18, respectively. In this instance, The inside panel is curved to generally track the curvature of the turntable 65. The housing also includes an upper, generally horizontal panel 77 sized to generally close off the interior of the housing. Thus, the housing provides for a generally L-shaped enclosure, when viewed from above, for the machine components.

With this arrangement, the turntable 65 is preferably located within and generally "fills" the open portion of the area which is partially enclosed by the generally L-shaped housing 15. Advantageously, utilizing the additional enclosed space gained by forming the inside arcuate panel 76 for the machine components results in a relatively narrow housing structure which further minimizes the floor space required for the machine 10. Thus, while access to the turntable is restricted on two sides, unrestricted access to the turntable is provided oppositely of the housing to enable, for example, a conventional forklift to load the coils of wire thereon.

Figure 3:
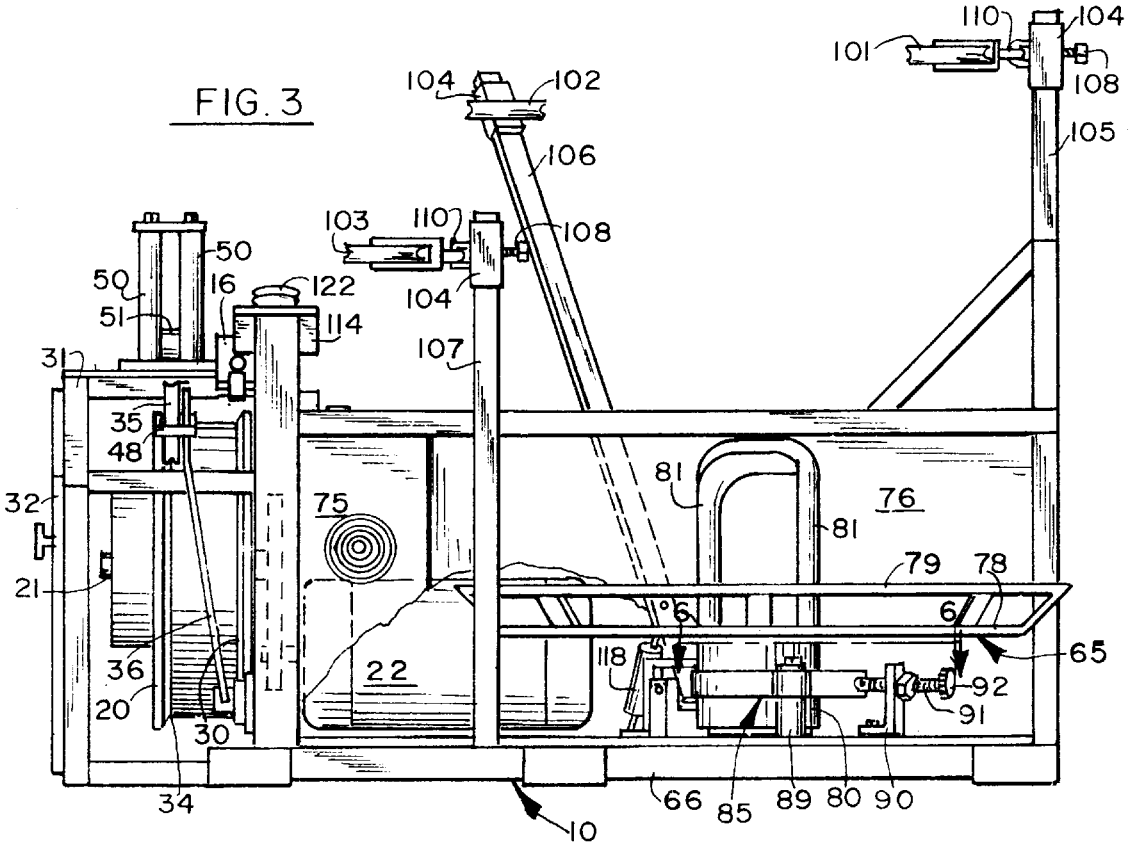
FIG. 3 is a rear elevational view of the machine.
Figure 7:
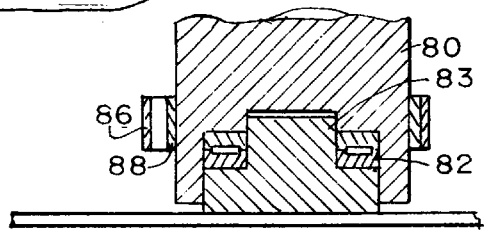
FIG. 7 is an enlarged fragmentary cross-sectional view taken substantially along the line 7—7 of FIG. 6.
Figure 4:
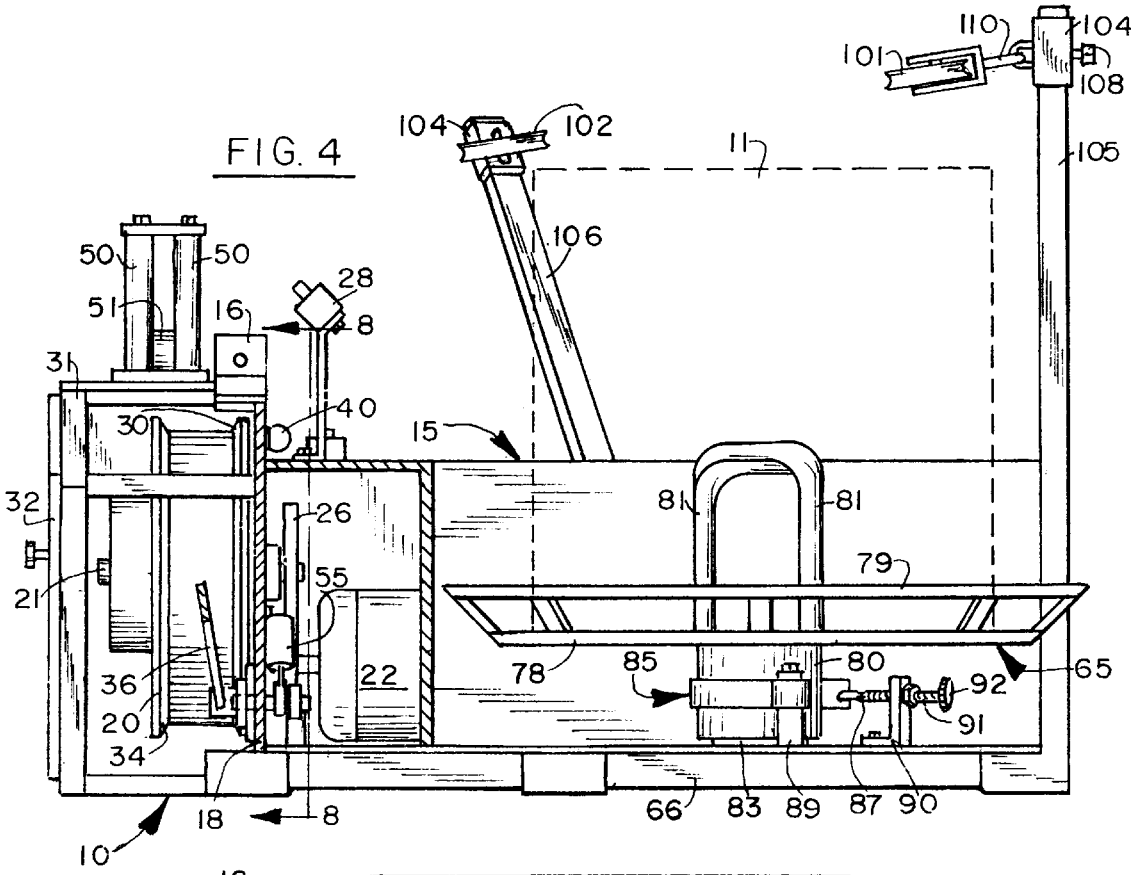
FIG. 4 is a rear view similar to FIG. 3 but showing certain parts as seen substantially from the line 4—4 of FIG. 2.

The turntable 65 includes a circular base plate 78 (FIG. 3), a basket-like structure 79 attached to and extending generally upwardly from the periphery of the base plate, and a centrally located hub 80 secured to the underside of the base plate. The turntable is mounted for free rotation about a vertical axis extending through the center of the turntable. In this instance, the hub 80 rests on a bearing 82 (FIG. 7) carried by a stub shaft 83 which extends upwardly from the base. In order to position the turntable relative to the housing 15, and to provide for guiding of the wire as further discussed below, the bearing 82 is located outside of the vertical plane extending laterally through the rear edge of the capstan 20. Two inverted U-shaped rods 81 extend upwardly from the center of the base plate are received into the coil 11 to guide and center the coil as it is lowered onto the turntable.

Figure 6:
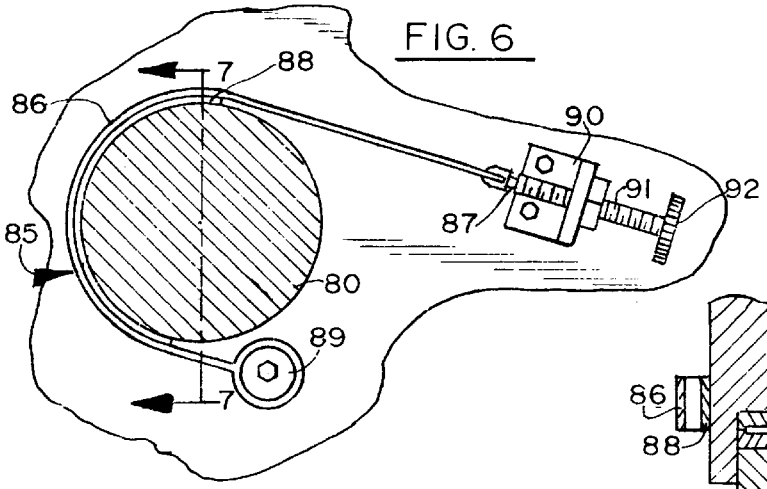
FIG. 6 is an enlarged fragmentary cross-sectional view taken substantially along the line 6—6 of FIG. 3.

Advantageously, a drag brake or friction band 85 (FIG. 6) is wrapped around the periphery of the hub 80 to prevent excess wire from unwinding from the coil 11 when the capstan 20 slows down or stops rotating. In the embodiment shown, the friction band includes a spring steel band 86 with a layer of commercially available friction material 88 on the inside surface of the metal band. One end of the band is firmly connected to a post 89 which extends upwardly from the base 66 of the machine 10. The opposite end of the band is connected to an adjustment screw 91 which is threaded through a support 90 fixed to the base of the machine. The post and support are preferably located so that the friction band engages the hub through an arc of approximately 180 degrees. A handle 92 at the opposite end of the adjusting screw enables the operator to set the friction drag between the band 85 and the hub 80 to insure that the turntable 65 rotates as the capstan draws wire through the die 12, but stops such rotation relatively quickly when the capstan stops rotating.

Further in accordance with the invention, the wire drawing machine 10 includes a unique, self-adjusting wire guiding arrangement for directing the wire 11*a* along a curved path above the housing 15 and generally within the outer boundaries defined by the housing and the turntable 65. As a result, additional floor space is not required for the path of the wire as it travels from the coil 11 to the die 12, and the total floor space required for the machine is minimized to the generally rectangular space which is needed for the housing and the turntable.

In carrying out this aspect of the invention, first, second, and third guide pulleys 101, 102, and 103, respectively, are positioned at a height above the housing 15 for guiding the wire 11*a* between the coil 11 and the die 12. The pulleys are connected to tubular sleeves 104 which are sized to slip onto elongated support arms 105, 106, and 107, respectively. The sleeves are secured to the support arms by screws 108 which are threaded through the sleeves and which engage the support arms, or by any other suitable, selectively engageable, fastening means.

For reasons which will become apparent, the pulleys 101, 102, and 103, are preferably connected to the sleeves 104 by, for example, a pin and clevis arrangement 110 so as to provide for freedom of pivotal movement of the pulley upwardly and downwardly, laterally, and forwardly and rearwardly (i.e., three degrees of freedom of movement), and to further provide for angular or rotational freedom of movement of the pulley axis of rotation.

In the embodiment shown, the pulleys 101, 102, and 103 are adapted to guide the wire 11*a* off of the coil 11 in a general semicircular path from the side of the machine opposite the capstan 20. In this instance, due to the placement of the capstan, and the fact that standard coils unwind in a counter-clockwise direction (when viewed from above), the first pulley 101 is located forwardly of the turntable 65 and is oriented to extend inwardly from the support arm 105 and toward the turntable. The height of the first pulley is set so that the wire will always raise at least slightly as it leaves the coil. The second pulley 102 also extends inwardly, and is positioned forwardly of the turntable and laterally between the first pulley and the capstan 20. The third pulley 103 is located diagonally from the first pulley and rearwardly from the second pulley.

The machine 10 also includes coacting pulleys 112 and 122 which are mounted to a support plate 114 for directing the wire 11*b* into the draw die 12. The axes of these pulleys are fixed relative to the die for establishing alignment between the wire 11*b*, the die and the inner edge portion 30 of the capstan 20 after the wire travels past the third pulley 103 and between the pair of pulleys 112, 122. An additional pulley 123 (FIG. 1) is selectively positionable to support the wire as it enters the die box 16 and is especially useful for small diameter wire.

With the foregoing arrangement, the pulleys 101, 102, and 103 are adapted to engage the wire 11*a* as it progresses from the coil 11 to the die 12, and to guide the wire in a curved and generally semi-circular path forwardly upon leaving the coil, laterally, and then rearwardly. In the embodiment shown, and since the wire is initially guided in a forwardly direction from the coil, the third pulley is oriented to coact with the rollers 112, 122 to reverse the direction of the wire so as to cause the wire to turn laterally and then forwardly toward the die. As a result, the wire of the machine 10 shown follows a substantially horizontal and generally S-shaped path between the coil and the die.

The wire in a coil 11 of unfinished wire typically retains a certain amount of memory which results in a normally occurring curvature in the wire after it is removed from the coil. Advantageously, the location and orientation of the pulleys 101, 102, 103 will automatically adjust to guide and self-align with the naturally tending path of the wire resulting, in part, from this memory. Moreover, the pulleys will automatically adjust at an increasing downwardly sloping angle as the wire unwinds from the coil and the height of the coil decreases. Thus, the unique wire guiding arrangement of the machine 10 eliminates the need for the prior conventional separation between the coil of unfinished wire and the capstan 20.

Figure 9:
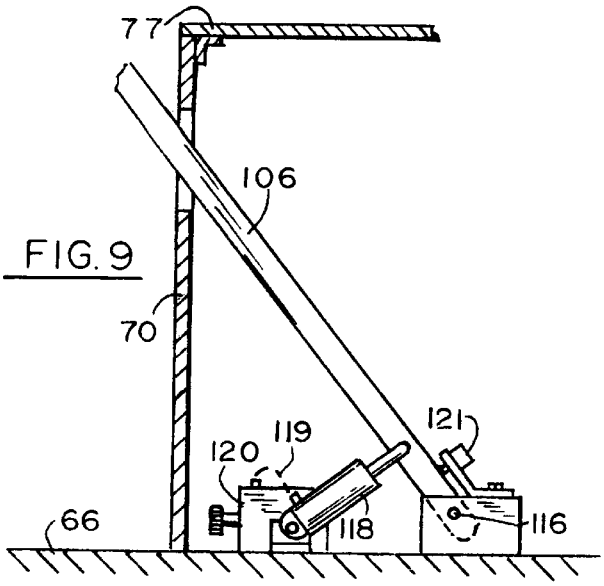
FIG. 9 is a view of certain parts as seen substantially from the line 9—9 of FIG. 2.

In keeping with the invention, snag-detection means (FIG. 9) are provided for automatically shutting down the machine 10 if the wire fails to freely pay-off of the coil 11. To this end, the second arm 106 is journaled to the base 66 for pivoting about a pin 116. A pneumatic cylinder 118 is connected between the base and the lower portion of the support arm. The cylinder is connected by pneumatic line 119 to an adjustable pressure regulator located inside the housing 15 and accessible through one of the access doors 72. With this arrangement, the cylinder 118 is adapted to counter-act the biasing weight of the arm 106 and raise the arm as the pressure in the cylinder is increased. Typically, the pressure in the cylinder 118 is set to and maintained at a predetermined pressure to maintain the arm in a normal operating position. In the event that, for example, the size of wire processed by the changes substantially, the operator can adjust the pressure regulator to move the arm to a different operating position.

If the wire snags on the coil 11 while the machine is operating, the arm 106 will be pulled inwardly from its preset position and toward the turntable 65. At a predetermined position, the inwardly drawn arm will engage and trip an electrical switch 121 which is operatively connected to the motor controller (not shown) to cause the machine to shut-down.

Figure 11:
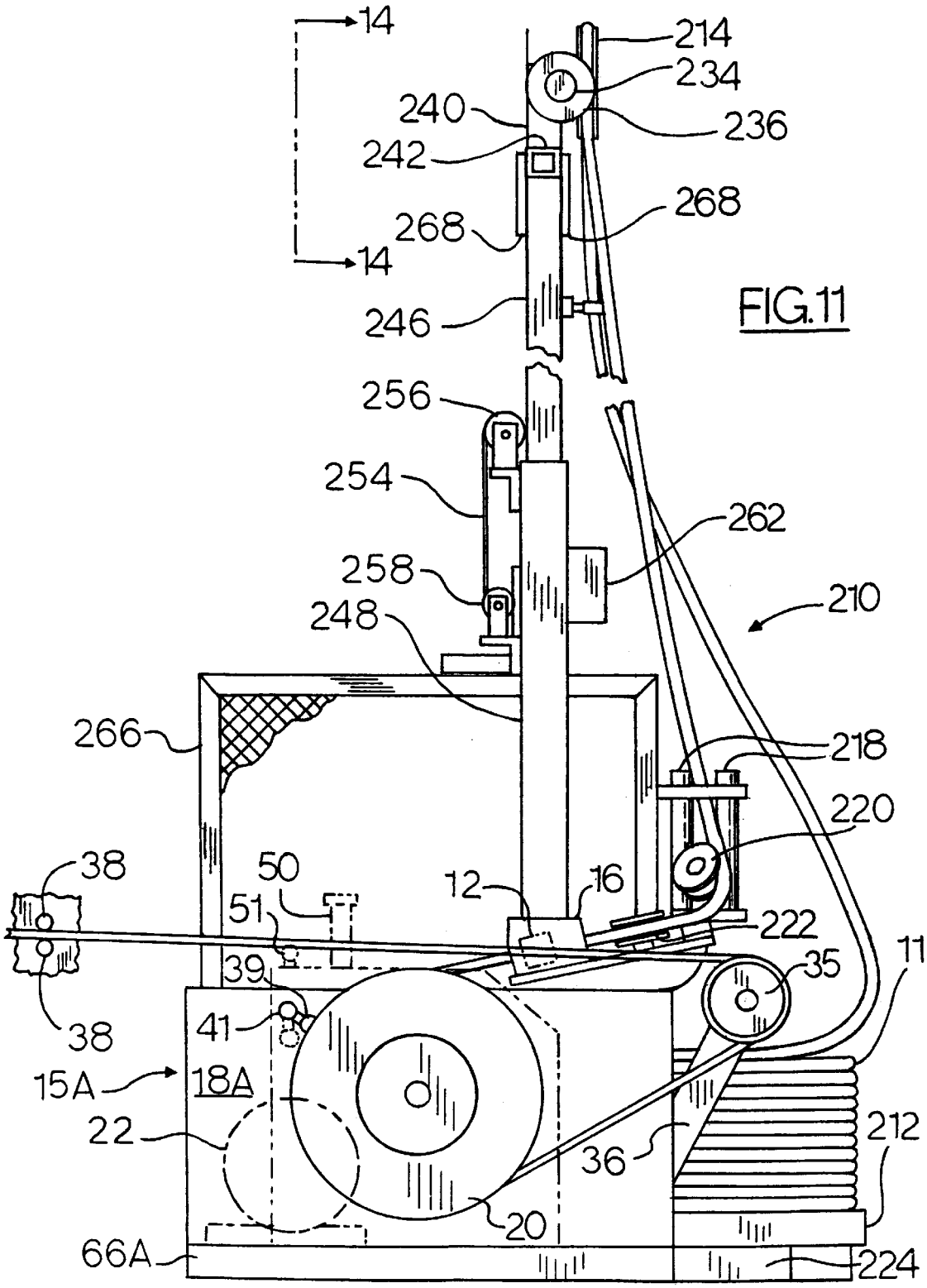
FIGS. 11–13 are view similar to FIGS. 1–3, respectively, of an alternate wire draw machine embodiment incorporating the unique aspects, and showing a coil of wire resting on a stationary table.
Figure 12:
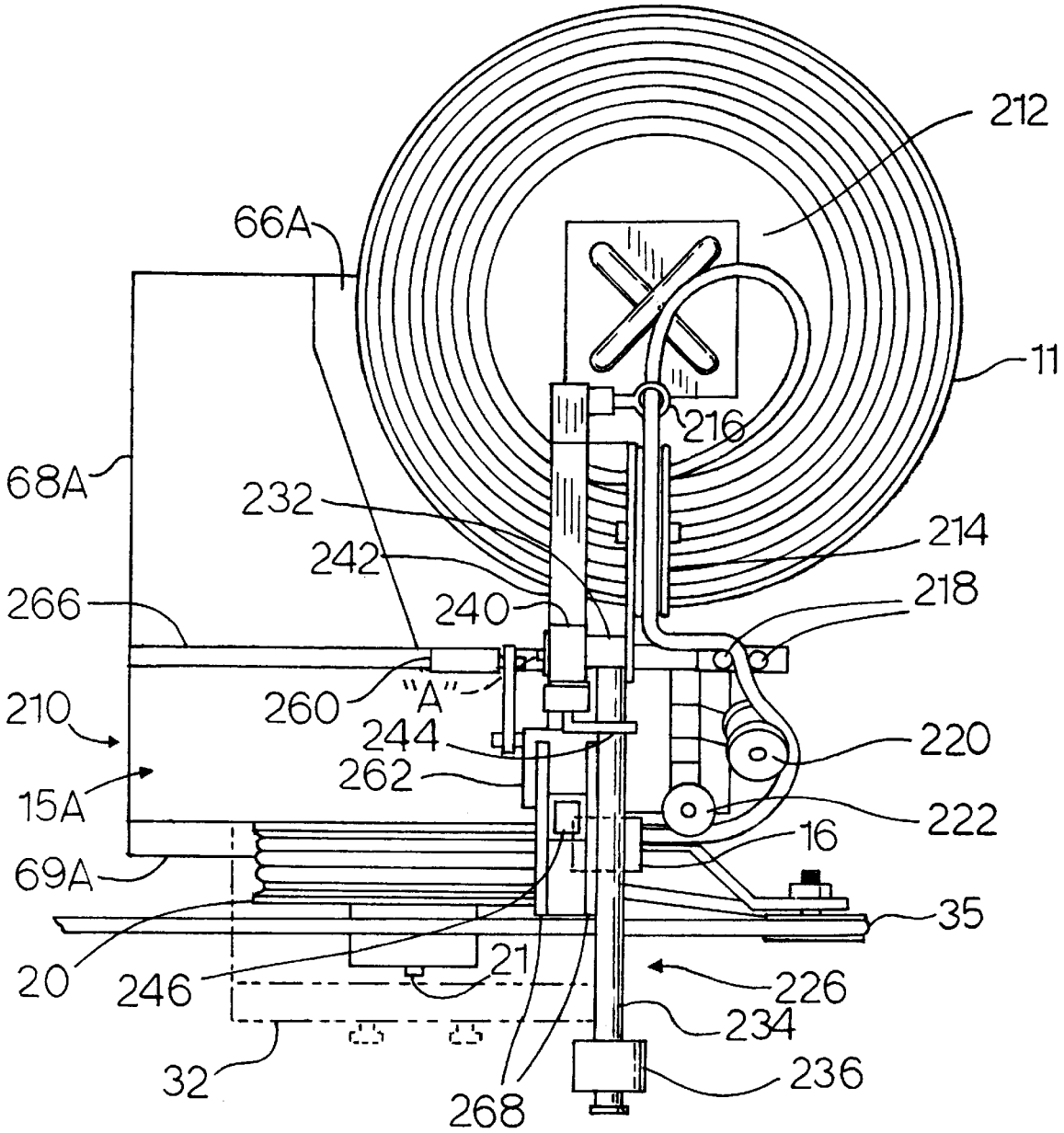
Figure 13:
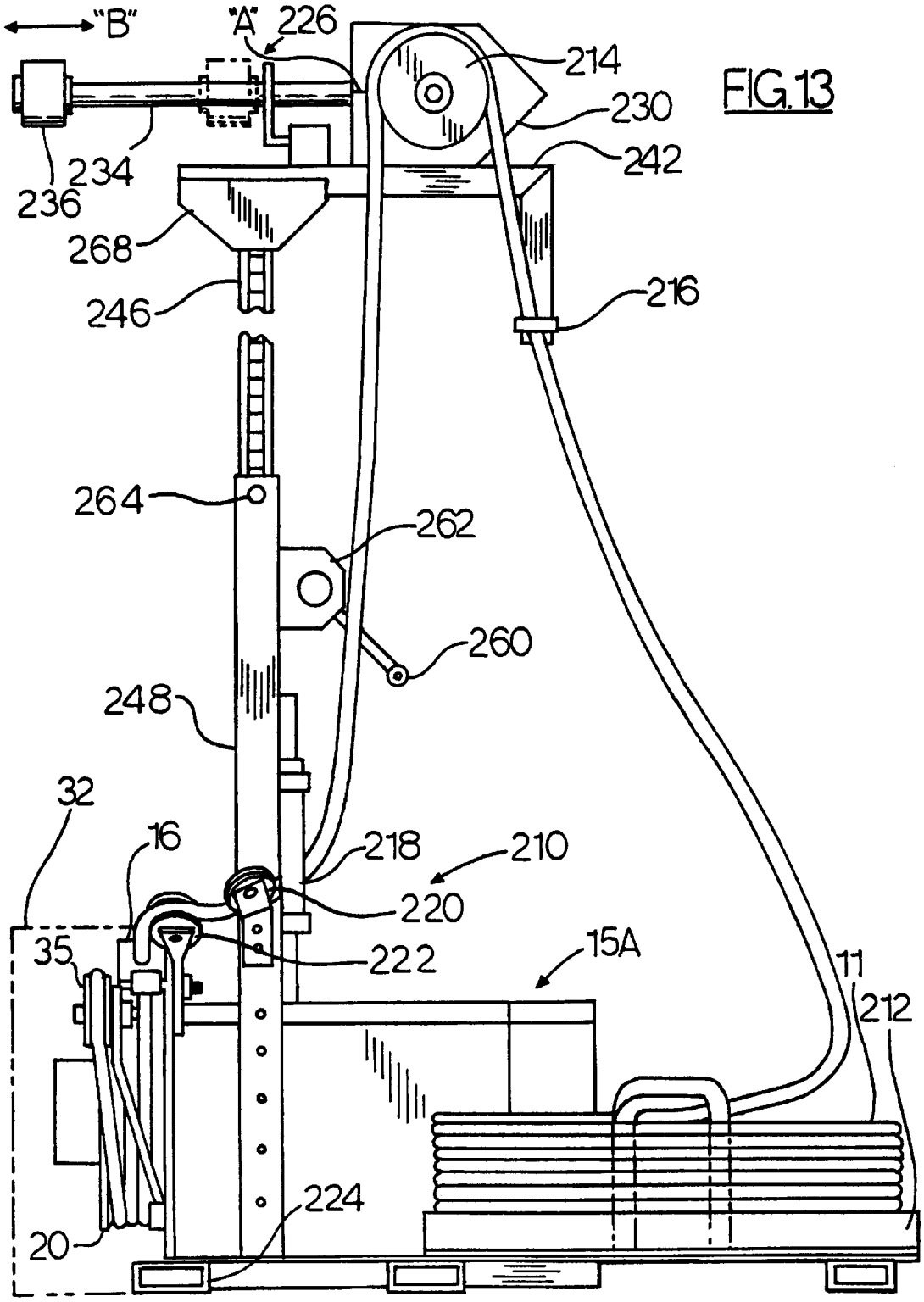

In an alternate embodiment that is especially useful where overhead space is not substantially restricted, a wire draw machine 210 (FIGS. 11–13) equipped with an integral coil-supporting table and generally L-shaped housing 15A partially surrounding the table is adapted for vertical pay-off from the coil 11 of wire. More specifically, the machine 210 is adapted to guide the wire upwardly from the coil and then downwardly to just preceding the die box 16, and to then turn the wire for entry into the die 12. As a result, the entire wire path between the coil and the die is maintained within the compact outer boundaries or footprint defined by the coil and coil-supporting table and housing 220 proximate thereto.

Figure 15:
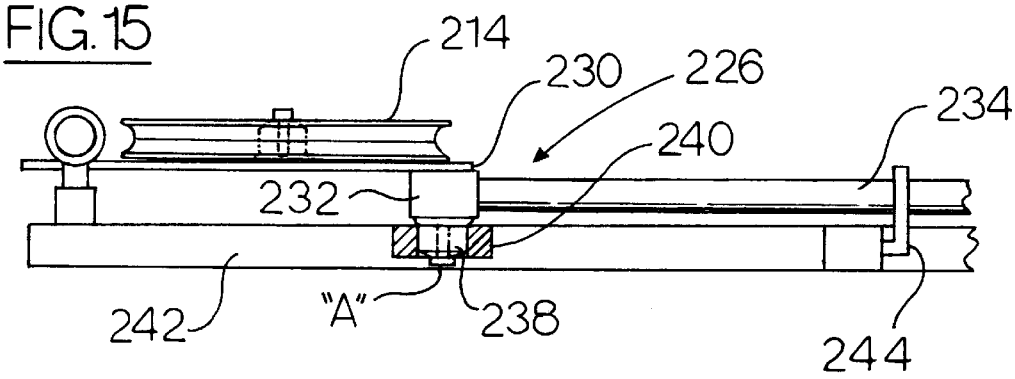
FIGS. 15–16 are views taken substantially along the lines 15—15 and 16—16 of FIG. 14.

In carrying out this embodiment, the vertical pay-off machine 210 includes a pulley 214 (FIG. 11) mounted above the coil 11 for rotation about a horizontal axis. A wire-guide eyelet 216 is laterally aligned with the vertical pulley 214 (see FIGS. 13 and 15), is located between the coil and the pulley, and is oriented with its opening extending vertically to guide the wire toward the pulley as it is drawn from the coil. Upon exiting the pulley, the wire travels downwardly and through a pair of vertical guide rollers 218 (FIG. 12) whereupon guide pulleys 220, 222 turn the wire from the substantially vertical path into alignment with the die 12, through which the wire is drawn and proceeds as described in connection with machine 10.

Advantageously, by virtue of this simple vertical wire pay-off guide arrangement, the machine 210 may be equipped with an integral coil-supporting table 212 that is stationary, and simply connected to the frame 224. Thus, the components and costs associated with a rotatable turntable such as utilized in the machine 10 are eliminated.

Figure 14:
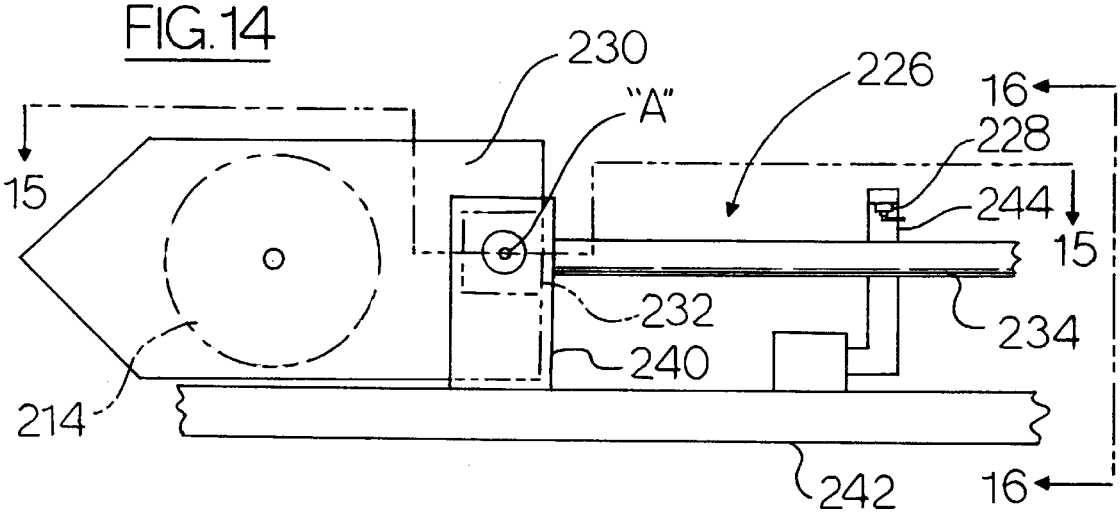
FIG. 14 is an enlarged view of certain parts of the machine of FIG. 11 as seen substantially along the line 14—14 of FIG. 11.
Figure 16:
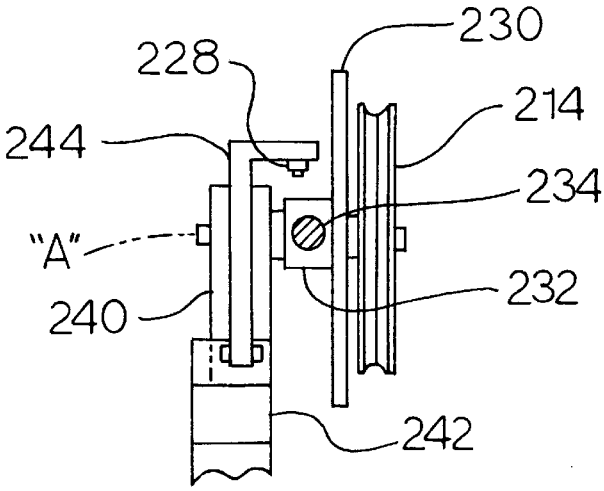

To effect snag detection in the vertical pay-off machine 210, the pulley 214 is mounted to a pivoting arm assembly 226 adapted to actuate a machine shut-down switch 228 in the event the wire snags as it pays-off the coil. In the embodiment shown, the pulley 214 is mounted to a vertical plate 230 which is connected to a hub 232. Extending from the hub in the opposite direction is an arm 234 which slidably carries an adjustable counterweight 236 that slides along the arm as indicated by arrow "B". The hub is mounted on a journal or on bearing 238 for pivoting of the entire assembly at axis "A" (FIGS. 14–15) and in a vertical plane preferably substantially coincident with the center of the table 212. The bearing 238 is carried in block 240 welded or otherwise connected to a platform or support beam 242 shown in the drawings in the form of a square tube. The electrical cut-off switch 228 is mounted to a bracket 244 and above the arm such as shown in FIGS. 14 and 16. The switch is electrically connected to the machine control circuit to provide an electrical signal that shuts the machine off in the event the switch is actuated.

The position of the counterweight 236 is adjusted and fixed on the arm 234, such as with a threaded fastener (not shown), at a location so that the arm assembly 226 balances at predetermined neutral position such as in a position with the arm angled slightly downwardly from horizontal. During normal operation of the machine, the force of the wire being drawn around the pulley 214 pivots the pulley downwardly and the arm upwardly from the neutral position to a normal operating position such as a substantially horizontal position shown in the drawings, with clearance between the arm and the cut-off switch 228 (see e.g., FIGS. 14 and 16). With the arrangement, if the arm pivots upwardly from its normal operating position and engages the switch, as will occur if a snag in the wire occurs during pay-off, the switch will actuate and shut the machine off, or stop rotation of the capstan 20.

Figure 17:
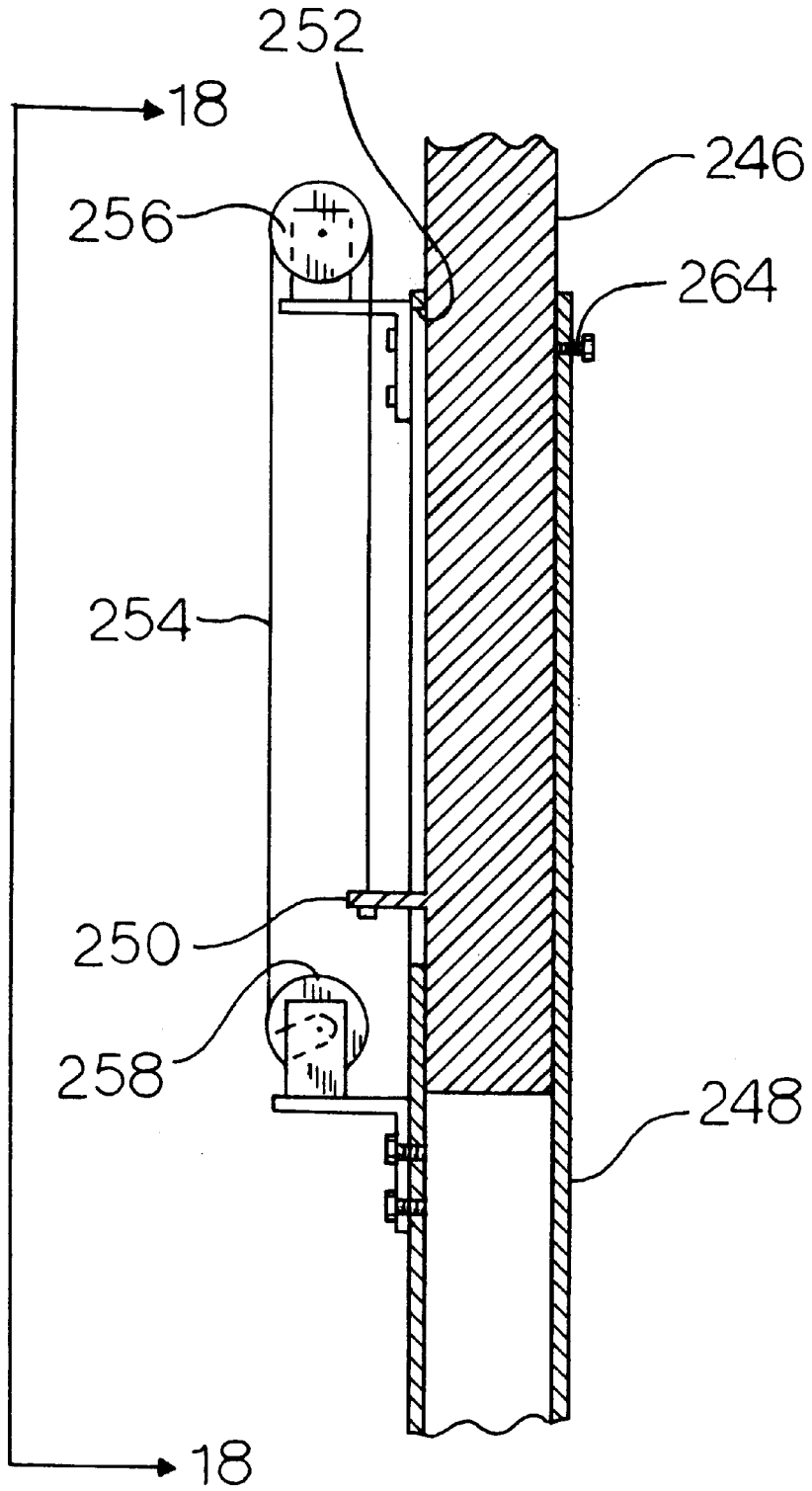
FIG. 17 is an enlarged view of certain additional parts seen in FIG. 13.
Figure 18:
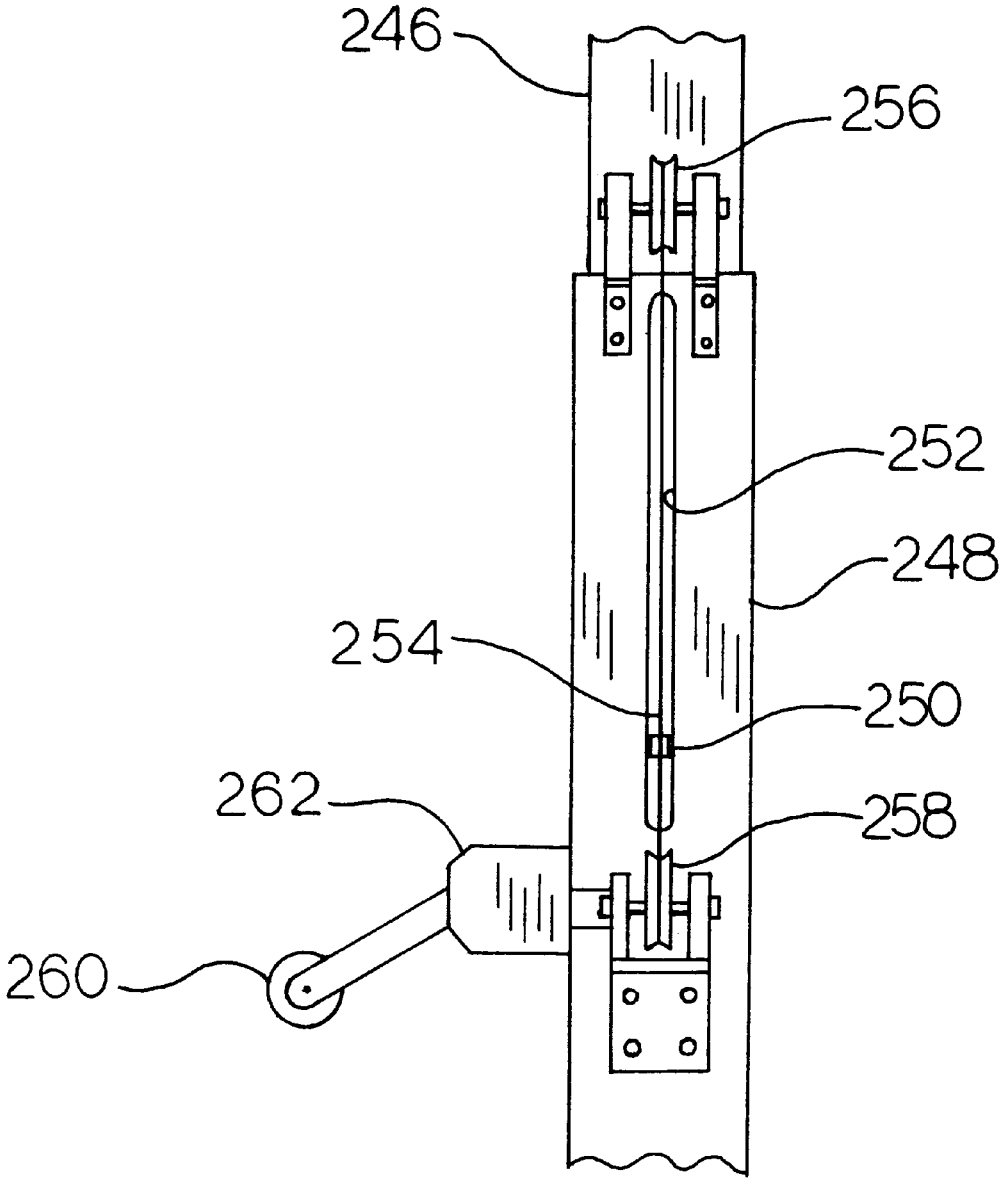
FIG. 18 is a view taken along the line 18—18 of FIG. 17.

In preferred embodiments, the machine 210 is provided with means for adjusting the height of the pulley 214, and thus the wire tension, for convenient processing of coils of different heights and wire of different diameters. In the embodiment shown, the arm assembly support beam 242 is mounted to the top of boom 246, such connection being reinforced with welded plates 266 on either side thereof. The boom is slidably received into a tube 248 that is connected to the frame or base 224 of the machine. To effect adjustment of the pulley, the boom is provided with a tab 250 (FIGS. 17–18) that is slidably received in a slot 252 in the side of the tube 248. The tab is connected to one end of a wire cable 254 that wraps around an upper rotatable pulley 256 and then around a lower rotatable pulley 258, the opposite end of the cable being secured to the lower pulley. The pulleys 256 and 258 are connected to the side of the tube 248 with brackets and threaded fasteners. Adjustment of the boom is accomplished with a handle 260 that is rotatably mounted and operably connected to the lower pulley 258 through a gear box 262 or other suitable means such that turning the handle raises the boom when wrapping the cable around the lower pulley, and lowers the boom when unwrapping the cable from the lower pulley. A threaded fastener 264 is provided in the tube 248 opposite the slot 252 to maintain the boom in position after adjustment has been made to the desired height. A safety screen 268 is also provided on the machine 210, and, of course may be provided on the machine 10, to protect the operator in the event the wire breaks while the machine is running.

Except as described herein, the machine 210 is similar in construction, operation and control, with the same or equivalent corresponding components (some of the components not being shown in the drawings of machine 210) as the machine 10, the equivalent components being designated with the same reference numerals but having the letter A added.

Those skilled in the art will appreciate that other alternate embodiment wire draw machines remain within the scope of the invention. For example, the vertical wire-guide arrangement of machine 210 may be used with a rotatable turntable such as provided for in machine 10 if desired, although such arrangement would result in the need for additional parts and machine complexity. It will also be apparent that the coil-supporting table need not necessarily be firmly fixed to the housing of the machine, but so long as the table is positioned as provided herein remains integral to the machine.

From the forgoing, it will be apparent that the present invention brings to the art a new and improved, compact wire drawing machine with an integral coil-supporting table and adjacent housing as illustrated and described in two alternate embodiments: one including a uniquely configured, substantially horizontal, wire guiding arrangement as shown in machine 10 that is especially useful where installation height may be limited, and the second including a vertical pay-off arrangement as shown in machine 210 that is suitable for use with a stationary table, both of which eliminate the need to establish a substantial distance between the coil of wire and the draw die and capstan 20, and thus substantially reducing the floor space necessary for the entire wire drawing operation as compared with conventional prior arrangements, while simultaneously providing for a coil-supporting table which is mounted on the floor with substantial unrestricted access for ease of loading coils of wire.

We claim:

1. A wire drawing machine adapted to unwind wire from a coil of wire, reduce the diameter of the wire, and supply the reduced-diameter wire to a using station located downstream of the machine, said machine comprising:

a support including a base and wall means connected to said base;

a drawing die mounted on said wall means;

a capstan located downstream of said die and mounted on said wall means for rotation about a generally horizontal axis;

means for rotating said capstan about said axis; said capstan being adapted to draw wire through said die as said capstan is rotated;

means for supporting the coil of wire; said supporting means including a turntable and journal means for rotation of said turntable about a generally vertical axis, said journal means being connected to said base and being located below a horizontal plane extending tangent to the upper edge of said capstan; and means for guiding the wire from the turntable to said die; said guiding means being connected to said support and being adapted to guide the wire through a generally curved path upon leaving the coil and progressing toward said die, said guide means including a plurality of pulleys mounted for rotation about a generally vertical axis during normal operation of the machine.

2. A wire drawing machine as defined in claim 1 further comprising brake means adapted to impart a continuous frictional drag on the rotation of said turntable for resisting such rotation but not stopping such rotation so long as said capstan is rotating.

3. A wire drawing machine as defined in claim 1 in which said path is substantially horizontal.

4. A wire drawing machine as defined in claim 1 in which said path follows a generally forwardly, laterally, and then rearwardly progressing curvature.

5. A wire drawing machine as defined in claim 4 in which said guide means further guide the wire along a reversing curvature in a generally laterally and then forwardly direction upon progressing downstream of said path and toward said die so as to define a generally S-shaped path between the coil and said die.

6. A wire drawing machine as defined in claim 1 in which at least one of said pulleys is mounted for pivotal movement in three degrees and for angular movement of the axis of rotation of said one pulley.

7. A wire drawing machine as defined in claim 1 further comprising means engaging the wire for detecting a snag in the wire and for automatically disabling said rotating means in response to detecting a snag.

8. A wire drawing machine as defined in claim 7, in which said snag detection means includes an elongated member connected to said support for swinging inwardly and outwardly relative to said turntable, means for biasing said member outwardly, and means for sensing movement of said member in said inwardly direction so as to effect disablement of said rotating means.

9. A wire drawing machine adapted to unwind wire from a coil of wire, reduce the diameter of the wire after leaving the coil, and supply the reduced-diameter wire to a using station located downstream of the machine, said machine comprising:

a support including a base and wall means connected to said base;

a drawing die mounted to said wall means;

a capstan located downstream of said die and mounted on said wall means for rotation about a generally horizontal axis;

means for rotating said capstan about said axis; said capstan being adapted to draw wire through said die as said capstan is rotated;

means connected to said base for supporting the coil of wire; said supporting means including a turntable and journal means for rotation about a generally vertical axis; said turntable being proximate said wall means such that access to said turntable is restricted by said wall means, there being generally unrestricted access to said turntable oppositely of said wall means; and means for guiding the wire from the turntable to said die as said capstan and said turntable rotate; said guiding means being connected to said support and being adapted to guide the wire through a generally curved path upon leaving the coil and progressing toward said die, said guide means including a plurality of pulleys mounted for rotation about a generally vertical axis during normal operation of the machine.

10. A wire drawing machine as defined in claim 9 in which said journal means is located below a horizontal plane extending tangent to the upper edge of said capstan.

11. A wire drawing machine as defined in claim 9 further comprising second wall means connected to said first wall means, said wall means being generally orthogonal so as to define a general L-shape when viewed from above, said L-shape comprising two sides of a generally rectangular space, said journal means being located within said rectangular space such that said wall means substantially surrounds said turntable through approximately 180 degrees.

12. A wire drawing machine as defined in claim 11 further comprising a generally upright and arcuate wall means connected to said first and second wall means, said arcuate wall means being proximate to and generally tracking the curvature of said turntable.

13. A wire drawing machine as defined in claim 9 further comprising brake means adapted to impart a continuos frictional drag on the rotation of said turntable for resisting such rotation but not stopping such rotation so long as said capstan is rotating.

14. A wire drawing machine as defined in claim 9 in which said path is substantially horizontal.

15. A wire drawing machine as defined in claim 9 in which said path follows a generally forwardly, laterally, and then rearwardly progressing curvature.

16. A wire drawing machine as defined in claim 15 in which said guide means further direct and guide the wire along a reversing curvature in a generally laterally and then forwardly direction upon progressing downstream of said path and toward said die so as to define a generally S-shaped path between the coil and the die.

17. A wire drawing machine as defined in claim 9 in which at least one of said pulleys is mounted for pivotal movement in three degrees and for angular movement of the axis of rotation of said one pulley.

18. A wire drawing machine as defined in claim 9 further comprising means engaging the wire for detecting a snag in the wire and for automatically disabling said rotating means in response to detecting a snag.

19. A wire drawing machine as defined in claim 18 in which said snag detection means includes an elongated member connected to said support for swinging inwardly and outwardly relative to said turntable, means for biasing said member outwardly (via weight), and means for sensing movement of said member in said inwardly direction so as to effect disablement of said rotating means.

20. A wire drawing machine adapted to unwind wire from a coil of wire, reduce the diameter of the wire, and supply the reduced diameter wire to a using station downstream of the machine, said machine comprising:

wall means;

a draw die connected to said wall means;

a capstan located downstream of said die and connected to said wall means for rotation about a generally horizontal axis;

means for rotating said capstan about said axis, said capstan being adapted to draw wire through said die as said capstan is rotated;

a turntable adapted to support the coil of wire;

journal means supporting said turntable for rotation about a generally vertical axis, said journal means being connected to said wall means; and a plurality of pulleys adapted to guide the wire from said coil to said die, said pulleys including a first pulley that is positioned to raise the wire to a height above both the coil and the capstan as the wire unwinds from the coil, said pulleys including a second pulley that is positioned to guide the wire along a substantially horizontal path that curves generally around said vertical axis.

21. A wire draw machine as defined in claim 20 in which at least one of said pulleys is mounted for angular movement of the axis of rotation of said pulley, said one pulley being positioned such that the angle from vertical of the axis of rotation increases as wire is drawn from the coil.

22. A wire draw machine adapted to unwind wire from a coil of wire, reduce the diameter of the wire, and supply the reduced-diameter wire to a using station downstream of the machine, said machine comprising:

(A) a base resting on the floor;

(B) housing means having two generally vertical leg portion wall means extending upwardly from the base and extending from one another at an angle cooperating to define a partially enclosed area therebetween when viewed from above;

(C) a draw die connected to one of said leg portion wall means;

(D) a capstan mounted to said one leg portion wall means outwardly of said partially enclosed area and downstream of said draw die for rotation about a horizontal axis;

(E) power drive means positioned in said housing means and operatively connected for rotating the capstan;

(F) table means for receiving and supporting the coil centered on a vertical axis extending therethrough, said table means (i) substantially filling said partially enclosed area and (ii) being located below a horizontal plane passing through the top of said capstan; and (G) means for guiding the wire along a path upwardly from the coil to a height above said housing means and said plane and then downwardly into said draw die as said capstan rotates and draws the wire through said die, said path lying generally above and substantially within the floor space enclosed by the outwardly lying ones of said coil, said housing means and said capstan.

23. A machine as defined in claim 22 in which said guide means carries the wire through a substantially horizontal, substantially circumferentially with respect to said vertical axis, and generally semi-circular path after being guided upwardly from the coil.

24. A wire draw machine adapted to unwind wire from a coil of wire, reduce the diameter of the wire, and supply the reduced-diameter wire to a using station downstream of the machine, said machine comprising:

(A) a base resting on the floor;

(B) vertical wall means connected to said base, said wall means having first and second generally oppositely facing sides;

(C) a draw die connected to the first side of said wall means;

(D) a capstan mounted to said first side downstream of said draw die for rotation about a horizontal axis;

(E) power drive means positioned on said base means and operatively connected for rotating the capstan;

(F) table means for receiving and supporting the coil centered on a vertical axis extending therethrough and positioned opposite said first side, said table means being positioned (i) proximate said second side of said wall means and (ii) below a horizontal plane passing through the top of said capstan; and (G) means for guiding the wire along a path upwardly from the coil to a height above said wall means and said plane and then downwardly into said draw die as said capstan rotates and draws the wire through said die, said path lying above and substantially within the floor space enclosed by the outwardly lying ones of said coil, said wall means and said capstan.

25. A wire draw machine as defined in claim 23 in which said wire guide means includes a first pulley that is positioned to raise the wire to said height as the wire unwinds from the coil, and a second pulley that is positioned to guide the wire through said substantially horizontal path.

26. A wire draw machine as defined in claim 25 in which said table means is mounted to said base for rotation about said vertical axis.

27. A wire draw machine as defined in claim 22 in which said wire guide means includes a pulley positioned to guide the wire upwardly through a substantially vertical path as the wire unwinds from the coil.

28. A wire draw machine as defined in claim 27 in which said table means is connected to said base.

29. A wire draw machine as defined in claim 27 in which said pulley is mounted for rotation about a first horizontal axis.

30. A wire draw machine as defined in claim 29 further comprising snag detection means operatively connected to said pulley.

31. A wire draw machine as defined in claim 30 in which said pulley is mounted for pivoting in first and second opposite directions about a second horizontal axis spaced from said first horizontal axis, said snag detection means including means for biasing said pulley in said first direction and means for detecting pivoting of said pulley in said second direction for detecting a snag as wire unwinds from a coil of wire.

32. A wire draw machine as defined in claim 24 in which said wire guide means includes a first pulley that is positioned to raise the wire to said height as the wire unwinds from the coil, and a second pulley that is positioned to guide the wire along a substantially horizontal path that curves generally around said vertical axis.

33. A wire draw machine as defined in claim 32 in which said table means is mounted to said base for rotation about said vertical axis.

34. A wire draw machine as defined in claim 24 in which said wire guide means includes a pulley positioned to guide the wire upwardly along a substantially vertical path as the wire unwinds from the coil.

35. A wire draw machine as defined in claim 34 in which said table means is connected to said base.

36. A wire draw machine as defined in claim 34 in which said pulley is mounted for rotation about a first horizontal axis.

37. A wire draw machine as defined in claim 36 further comprising snag detection means operatively connected to said pulley.

38. A wire draw machine as defined in claim 37 in which said pulley is mounted for pivoting in first and second opposite directions about a second horizontal axis spaced from said first horizontal axis, said snag detection means including means for biasing said pulley in said first direction and means for detecting pivoting of said pulley in said second direction for detecting a snag as wire unwinds from a coil of wire.

39. A wire drawing machine adapted to unwind wire from a coil of wire, reduce the diameter of the wire, and supply the reduced diameter wire to a using station downstream of the machine, said machine comprising:

wall means;

a draw die connected to said wall means;

a capstan located downstream of said die and connected to said wall means for rotation about a generally horizontal axis;

means for rotating said capstan about said axis, said capstan being adapted to draw wire through said die as said capstan is rotated;

table means for receiving and supporting a coil centered on a vertical axis extending therethrough, said table means being located proximate said wall means;

means for guiding the wire along a path upwardly from the coil to a height above said wall means and then downwardly into said draw die, said path lying above and substantially within the floor space enclosed by the outwardly lying ones of said coil, said wall means and said capstan;

said guide means including a pulley mounted for rotation about a first axis and generally positioned at said height for guiding the wire upwardly as it unwinds from the coil, said pulley being mounted for pivoting about a second axis spaced from said first axis and being pivotally responsive to a snag in the wire as it unwinds from the coil; and snag detection means operatively connected for detection of pivoting of said pulley resulting from a sang in the wire.

* * * * *